US007698875B2

(12) United States Patent
Matsuoka et al.

(10) Patent No.: US 7,698,875 B2
(45) Date of Patent: Apr. 20, 2010

(54) METHOD OF MANUFACTURING A CAKE-SHAPED DECORATIVE ACCESSORY MADE OF A TOWEL

(75) Inventors: Yoshiyuki Matsuoka, Osaka (JP); Tadayoshi Iwaki, Osaka (JP)

(73) Assignee: Prairie Dog Co., Ltd., Osaka (JP)

( * ) Notice: Subject to any disclaimer, the term of this patent is extended or adjusted under 35 U.S.C. 154(b) by 372 days.

(21) Appl. No.: 11/318,964

(22) Filed: Dec. 27, 2005

(65) Prior Publication Data

US 2006/0138012 A1 Jun. 29, 2006

(30) Foreign Application Priority Data

Dec. 28, 2004 (JP) ..... 2004-381814

(51) Int. Cl.
*B65B 63/04* (2006.01)

(52) U.S. Cl. ..... 53/429; 53/116

(58) Field of Classification Search ..... 53/429, 53/430, 116, 117, 118, 119; 463/405, 406, 463/408, 480, 938; 206/292, 297, 812, 570
See application file for complete search history.

(56) References Cited

U.S. PATENT DOCUMENTS

| | | | | | |
|---|---|---|---|---|---|
| 1,346,441 | A | * | 7/1920 | Cannon | 206/581 |
| 2,226,231 | A | * | 12/1940 | Morse | 53/399 |
| 2,573,827 | A | * | 11/1951 | Bigelow | 53/117 |
| 3,274,045 | A | * | 9/1966 | Smith | 493/480 |
| 3,448,557 | A | * | 6/1969 | Swaithes | 53/117 |
| 3,735,694 | A | * | 5/1973 | Richards et al. | 99/450.1 |
| 3,750,916 | A | * | 8/1973 | Stringer et al. | 53/117 |
| 3,774,903 | A | * | 11/1973 | Sjoman et al. | 493/938 |
| 4,037,386 | A | * | 7/1977 | Sjoman | 53/429 |
| 4,240,553 | A | * | 12/1980 | Leopold | 206/297 |
| 4,928,831 | A | * | 5/1990 | Kirsch | 206/575 |
| 5,154,329 | A | * | 10/1992 | Dorfmueller | 206/297 |
| 5,175,977 | A | * | 1/1993 | Crawford et al. | 53/429 |

FOREIGN PATENT DOCUMENTS

| | | |
|---|---|---|
| JP | 49-121768 | 10/1974 |
| JP | 53-5162 | 1/1978 |
| JP | 63-112715 | 5/1988 |
| JP | 3-22795 | 3/1991 |
| JP | 3-22796 | 3/1991 |
| JP | 3-39488 | 4/1991 |

(Continued)

*Primary Examiner*—Louis K Huynh
(74) *Attorney, Agent, or Firm*—William L. Androlia; H. Henry Koda

(57) ABSTRACT

A method of manufacturing a cake-shaped decorative accessory made of a towel by setting a mount, which becomes a framework for forming a towel cloth in a cake shape, on a towel cloth, and folding the towel cloth together with the mount into a cake shape. More specifically, a cake-shaped decorative accessory made of a towel is obtained by: setting a polygonal shape mount, which has a folding piece extending from each one of sides thereof, on a towel cloth which is larger than the mount; folding the towel cloth together with the folding piece of the mount to form a folded item; and placing the folded item in a cake cup with a top face portion of the mount facing above, thus forming the folded item into a cake shape.

4 Claims, 4 Drawing Sheets

FOREIGN PATENT DOCUMENTS

| | | | | |
|---|---|---|---|---|
| JP | 5-15557 | | | 4/1994 |
| JP | 6-15558 | | | 4/1994 |
| JP | 08151089 | A | * | 6/1996 |
| JP | 9-168490 | | * | 6/1997 |
| JP | 3047641 | | | 4/1998 |
| JP | 11-140707 | | | 2/1999 |
| JP | 3067357 | | | 1/2000 |
| JP | 2003-12074 | | | 1/2003 |

* cited by examiner

METHOD OF MANUFACTURING A CAKE-SHAPED DECORATIVE ACCESSORY MADE OF A TOWEL

BACKGROUND OF THE INVENTION

1. Technical Field

The present invention relates to a decorative accessory made of a towel and more particularly to a method of manufacturing a cake-shaped decorative accessory made of a towel that closely resembles a real cake.

2. Description of the Related Art

Currently, towels sold as, for instance, a gift are folded in various manner and arranged in a storage box, and the top side of the storage box is covered with a transparent film, so that the customers can see the arranged towel(s) inside the box through the film, thus drawing the attention of the customers and increase the customer's desire to purchase. Among these, with the focus on characteristics such as the towel's texture, thickness, and flexibility, some towels are formed into animals and dolls by way of attaching the towel cloth by sewing or fastening with a pin or the like, thus being offered exclusively as decorations.

Cake-shaped decorations using towels are known, and towels folded into a rolled cake shape and towels entirely packaged in decorative containers are also known well, as disclosed in, for example, Japanese Utility Model Application Laid-Open (Kokai) Nos. 3-39488, 3-22795 and 3-22796.

However, the towel folding processes are almost all performed manually by persons; and even if the original towel size is the same, due to the differences in force applied during the folding process, or the like, variations in shapes and sizes occur in the towels folded into, for instance, a cake.

BRIEF SUMMARY OF THE INVENTION

In view of the problems above, the object of the present invention is to provide a method of manufacturing a decorative accessory with a towel and to provide a decorative accessory made of a towel formed thereby for which variations in, for instance, sizes and shapes, does not occur in the completed product.

The above object is accomplished by the unique steps of the present invention for a method of manufacturing a cake-shaped decorative accessory from a towel; and the present invention includes the steps of:

- setting a mount or a core on a towel cloth, the mount (core) becoming a framework for forming the towel cloth in a cake shape, and
- folding the towel cloth together with the mount into a cake shape.

The mount (core) is a paper template that forms a cake shape of a desired size and shape; accordingly, by folding the towel cloth using the mount as a guide, the completed towel cakes have the uniform size and shape. Therefore, no variation occurs in the size and shape regardless of who makes it, and mass production is possible using a large number of people.

The material for the towel cloth is not particularly limited as long as it is a towel cloth such as a pile weave or the like, and a cotton towel is more preferable among those. As to the mount, an item having a certain level of strength as a template is preferable; and preferred examples include thick paper, plastic, cardboard, or the like, but not limited to these. In terms of ease of use, a thick paper is preferable for the mount.

As to the shape of cake, examples include cakes in which the plan view is triangular, square, or round, and rolled cakes or the like, not being limited to these example shapes.

When forming a triangular short cake shape, it takes the steps of:

- setting a polygonal shape mount, which has a folding piece extending from each one of sides thereof, on a towel cloth which is larger than the mount,
- folding the towel cloth together with the folding piece of the mount to form a folded item, and
- placing the folded item in a cake cup with a top face portion of the mount facing above, thus forming the folded item into a cake shape.

Also, when forming a rolled cake shape,

- a mount that has a rectangular shape is used, and
- the towel cloth is folded along longer sides of the rectangular shape mount so as to wrap up the mount, and then the towel is rolled together with the mount from one of shorter sides of the rectangular mount, thus forming the towel cloth into a rolled cake shape.

The cake-shaped decorative accessories made of a towel obtained using the method described above do not vary in shape and size, not being affected by the forces of the persons forming the cake shape, thus providing completed products of substantially the same size and the same shape.

The cake cup used in the present invention has a container shape. It has the same shape as the cake formed by the towel cloth and mount, and it has the size so that the cake will be snugly placed therein. The material for the cup is not particularly limited, and cups made of paper or plastic are preferable; and those made of paper or plastic and used for an actual cake are more preferable. The cake cup can be colored or colorless, and it can be transparent or semi-transparent. Also, it is of course also possible to add a pleat or the like to the cup wall. By placing the towel folded in a cake shape in such a cup, it is possible to make the external appearance of the towel cake look alike a real cake.

Furthermore, it is also possible to add decorations to the towel cake. Such decorations include actual or imitation items of fruits such as strawberries or cherries, or plants like leaves or flowers, or ribbons or the like, thus making the towel cake have the external appearance of an actual cake. In addition, by packaging the entire cake in a transparent film, the towel cake can make a perfect present item.

According to the present invention, the mount is a paper template, so that the towel cakes are uniform in size. Therefore, it is possible to provide a method of manufacturing a decorative accessory made of a towel formed thereby for which variation does not occur in the completed towel cake in terms of size and shape.

Also, since the towel cloth texture, expansion, flexibility, and the like create the appearance of the actual cake in a cup, people's eyes are drawn by the cute cake shape, and the towel cake can be used as a gift item perfect for presentation or as a decorative item for interior decorations. Also, when the towel in the cake shape is taken out of the cup and unfolded, it returns to its original shape, and it is used as a towel; and the decorations decorated the cake shaped towel can be used for other purposes.

DETAILED DESCRIPTION OF THE INVENTION

The aspects of implementing the present invention are as described below. However, the description is for nothing but the examples of implementing the present invention, and the present invention is not limited to the shown embodiments.

Figure 1A:
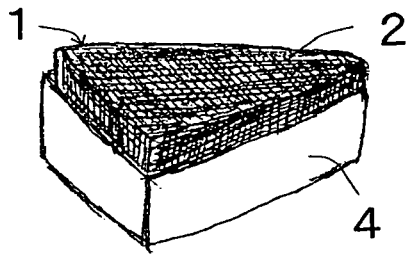
FIG. 1A is a perspective view of the decorative accessory made of a towel according to the first embodiment of the present invention.
Figure 1B:
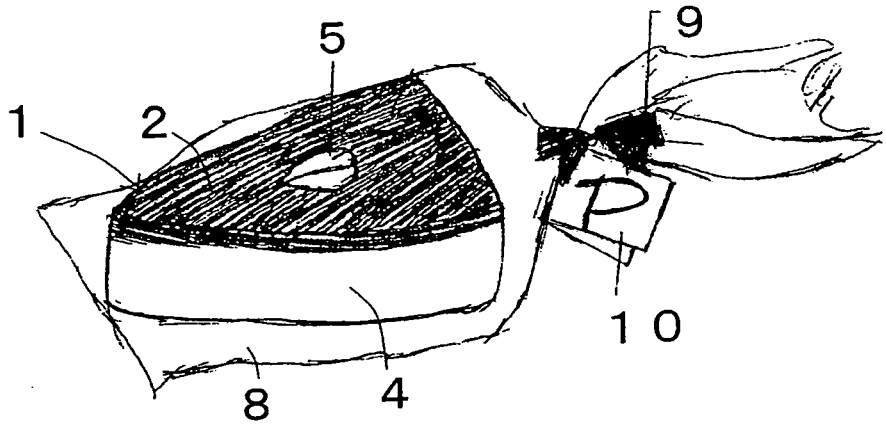
FIG. 1B is a perspective view of the decorative accessory of FIG. 1A packaged in a transparent film bag and completed as a packaged product.
Figure 2:
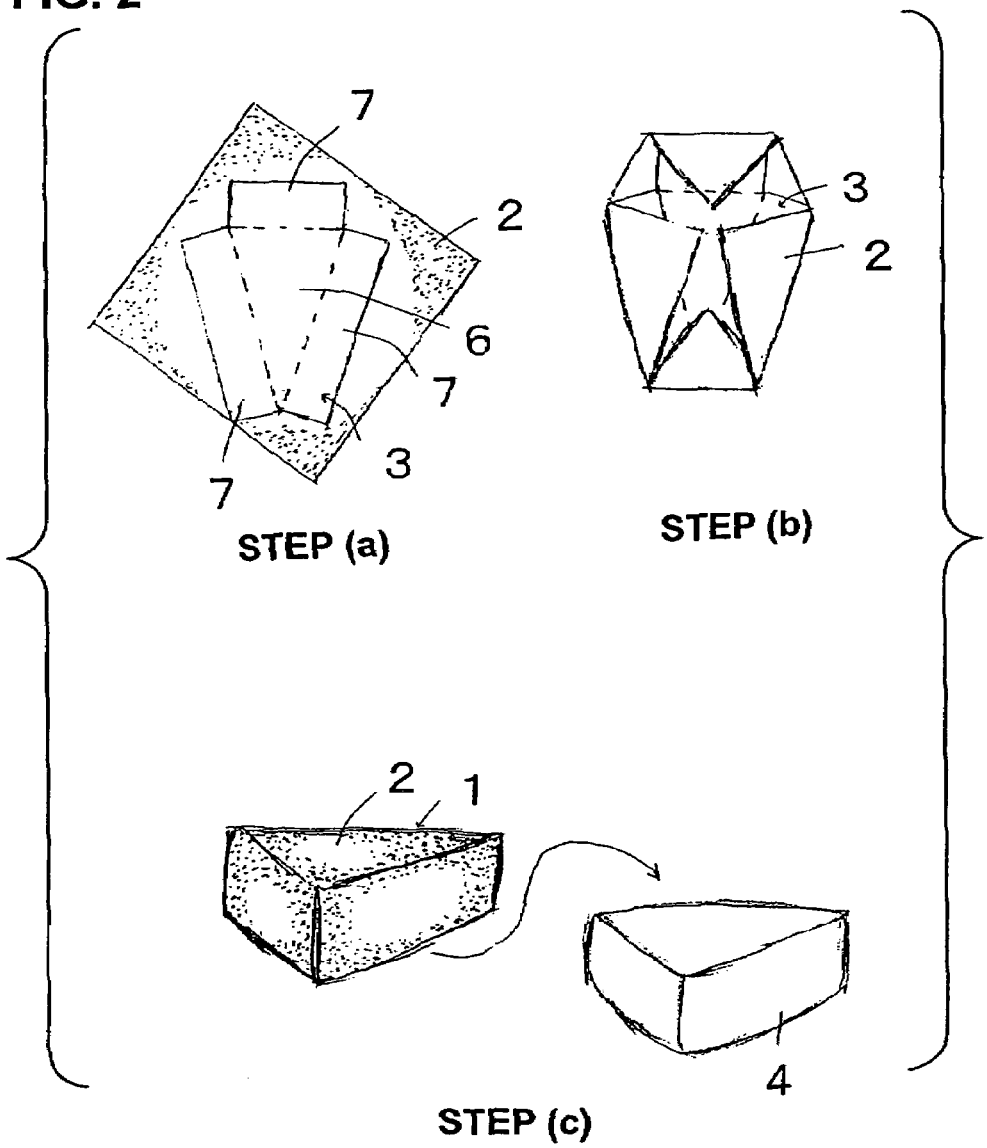
FIG. 2 shows the manufacturing steps (a) through (c) of the decorative accessory made of a towel of the first embodiment.

FIG. 1A shows an example of a decorative accessory made of a towel according to the first embodiment of the present invention, being a perspective view of the decorative accessory formed in a triangular-shaped short-cake shape; and FIG. 1B shows the decorative accessory packaged in a transparent film bag which is closed and tied near the opening using a ribbon string or the like and completed as a packaged item. FIG. 2 shows the steps of manufacturing the decorative accessory made of a towel of the first embodiment.

The decorative accessory made of a towel is comprised of a cake body 1 and a container or cake cup 4. The cake body 1 is made from a towel cloth 2 and a mount (or a core) 3 which is a paper template for the towel cloth 2, and the cake cup 4 contains therein the cake body 1 (with the mount 3). It is possible to add a decoration 5 on top of the cake body 1. The cake body 1 is formed by overlapping the towel cloth 2 over the mount 3 and folding into a cake shape as shown in FIG. 2.

The towel cloth 2 shown in FIG. 2 has a regular tetragon shape, but it is not limited to shape. The towel cloth 2 can be of any shape including rectangle and triangle because if it is folded using the mount 3 as a guide, the towel cloth 2 can be put in any desired size and shape.

The towel cloth 2 is bigger than the unfolded mount 3 in size. Also, the color of the towel cloth 2 can be suitably selected so that it matches the actual cake color and size. For example, so as to match a white whipped cream cake, white towel is employed; so as to match a chocolate cake, a chocolate color (brown) towel is used; and so as to match a caramel cake, a caramel color towel is used.

As shown in step (a) of FIG. 2, the mount 3 is comprised of a the polygonal (triangle in the shown embodiment) top face portion 6, which forms the framework for the top face of the cake body 1, and folding pieces 7, which extend from the edges of the top face portion 6 and form the framework for the side surfaces of the cake body 1. So as to make it easy to bend the folding pieces 7, slits or the like are formed at the border between the folding piece 7 and the top face portion 6. As the material for the mount 3, though not limited, a thick paper is used.

The cake cup 4 is made of a semitransparent synthetic resin. The cake cup 4 is a container of a triangular shape when viewed from above in the shown embodiment. The cake cup 4 is slightly larger in overall size than the towel cake body 1, and it is formed so as to snugly contain therein the cake body 1. So as for the top portion of the cake body 1 to protrude from the upper edge of the cake cup 4, it is preferable that the height of the cake cup 4 is slightly smaller (lower) than that of the cake body 1.

The decoration 5 is formed in a leaf shape, and a magnet (not illustrated) is attached to the back surface. As a result, the leaf shaped decoration 5 can be used as a magnet or memo clip after being removed from the cake-body 1.

The decorative accessory made of a towel is manufactured by the steps described below.

First, the square shaped towel cloth 2 larger than the mount 3 is spread and set flat, and the mount 3 is set on this towel cloth 2 or inside thereof so as to be held within the towel cloth 2 in step (a). At this time, it is preferable that the mount 3 be placed diagonally with respect to the towel cloth 2. In other words, the mount 3 is placed so that the diagonal line of the regular tetragon-shaped towel cloth 2 and a line perpendicular to the bottom side of the triangle of the top face portion 6 of the mount 3 are roughly overlapped or coincident. By way of setting the mount 3 like this on the towel cloth 2, the corners of the square towel cloth 2 can be easily folded to the inside or towards the center of the towel to wrap up the mount 3 when the towel cloth 2 is folded as described below.

Next, in step (b), the towel cloth 2 is folded to the inside along the edges of the mount 3 or is folded along the edges of the mount 3 so as to wrap up the mount 3 therein. At this time, portions between one folding pieces 7 and another folding piece 7 next to it comes in, making it difficult to fold, thus leaving such portions of the towel cloth "as is".

Then in step (c), the folding pieces 7 covered by the towel cloth 2 are bent along the borders with the top face portion 6 of the mount 3 so as to rise at substantially right angles with respect to the top face portion 6, and simultaneous with this, the portions of the towel cloth 2 located between the folding pieces 7 are pressed toward the inside of the mount now in a box shape. As a result, the cake body 1 is formed with the top face portion 6 of the mount 6 being underneath the top face of the cake body 1. Thereafter, the cake body 1 is put in the triangular cake cup 4, so that a towel decorative accessory is completed (see FIG. 1A). Since the cake cup 4 is lower than the cake body 1, the cake body 1 forms a protruding portion on the top part that protrudes upward from the opening of the cake cup 4.

Though the cake-shaping process can be finished at this point, further steps can be taken to make the towel cake look fancier. In other words, a leaf shaped decoration 5 can placed on top of the cake body 1 (see FIG. 1B), the cake body 1 with the leaf shaped decoration 5 can be placed in a transparent film 8 made of polypropylene and wrapped by the film 8. The opening of the film package is closed and tied with a plastic material (not illustrated) such as a decorative wire at the opening of the transparent film 8, and then a ribbon 9 and a tag 10 are attached.

As seen from the above, when the towel is formed into a cake shape in the manner as described above, it is possible to unify the size and shape of the completed towel product; and a decorative accessory made of a towel that appears as attractive and delicious as a real cake is obtained.

Figure 3A:
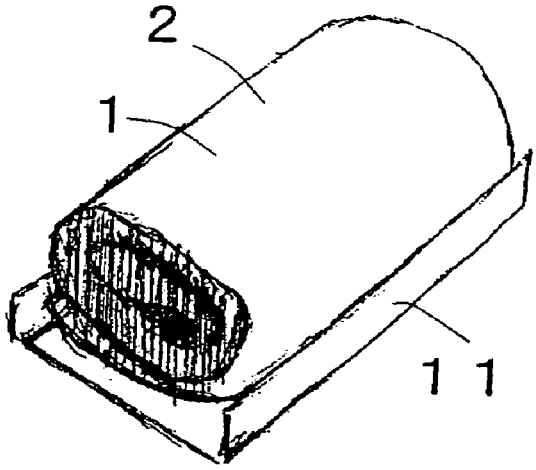
FIG. 3A is a perspective view of the decorative accessory made of a towel according to the second embodiment of the present invention.
Figure 3B:
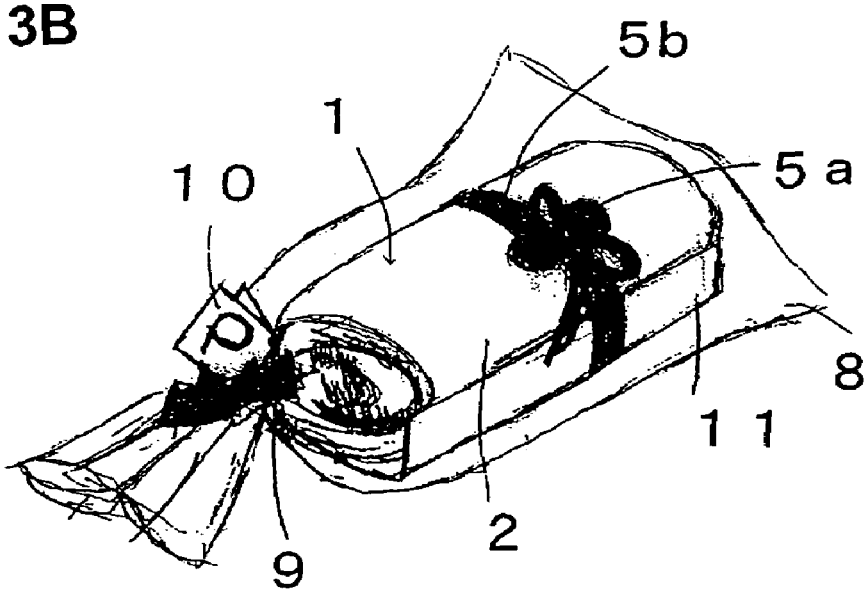
FIG. 3B is a perspective view of the decorative accessory of FIG. 3A packaged in a transparent film bag and completed as a packaged product.
Figure 4:
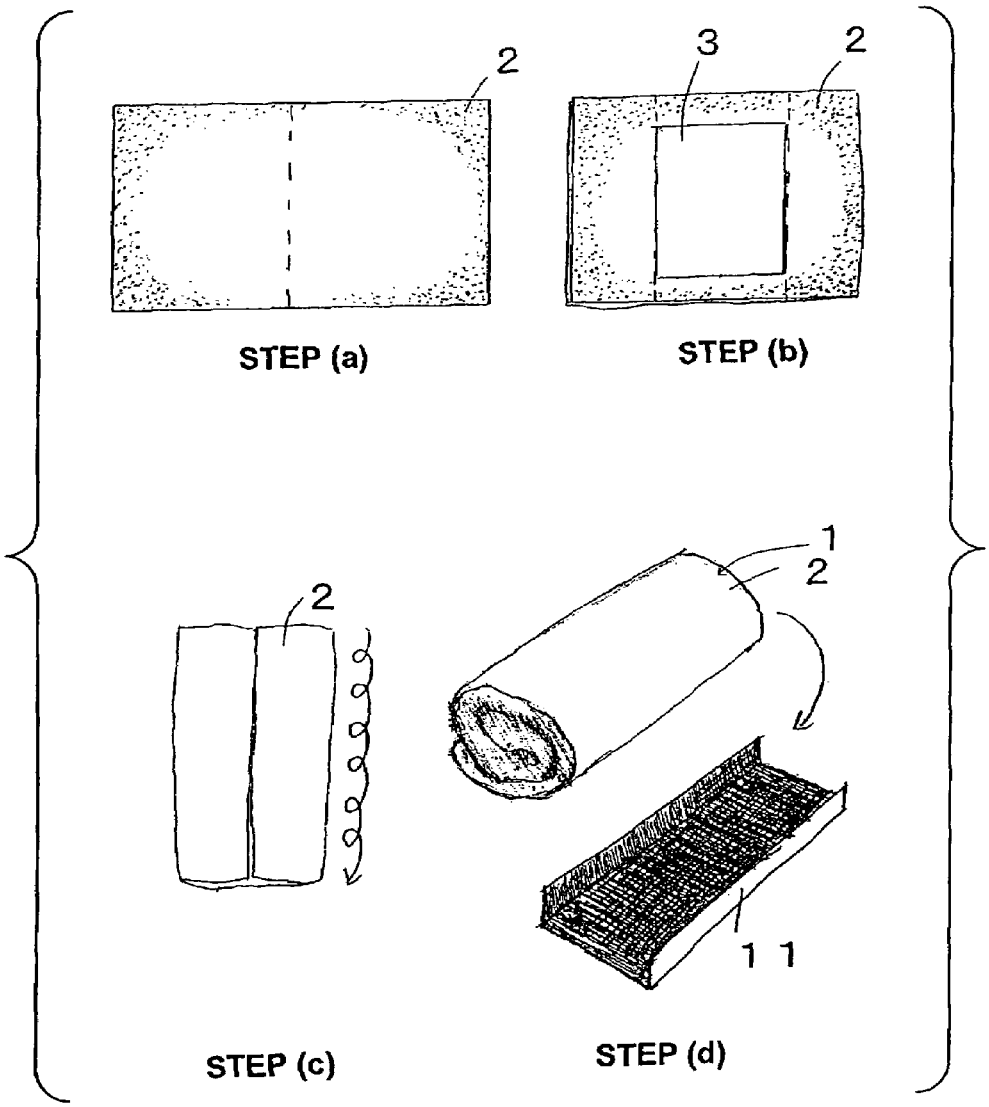
FIG. 4 shows the manufacturing steps (a) through (d) of the decorative accessory made of a towel of the second embodiment.

FIG. 3A is a perspective view of a cake-shaped decorative accessory made of a towel in the shape of a rolled cake according to the present invention. FIG. 3B shows this cake-shaped decorative accessory with a ribbon 5*b* and a decoration 5*a* in the form of a cherry placed on this decorative accessory. The cake-shaped decorative accessory is packaged in a transparent film bag 8 with its opening area is closed and tied with a ribbon string 9 or the like and is thus completed as a packaged product. FIG. 4 shows the manufacturing steps (a) through (d) of the decorative accessory made from a towel of FIG. 3A. The material of the towel cloth 2, the mount 3, and the like are the same as those of the first embodiment.

In this second embodiment, the towel decorative accessory is comprised of the cake body 1, which is made from the towel cloth 2, the mount 3 that is a paper template for the towel cloth 2, and a cake holder 11 on which the cake body 1 is placed. The decoration is added to this towel decorative accessory.

The towel cloth 2 used is in a rectangular shape but is not limited to rectangular, and it can take any shape such as a regular tetragon, triangle, or the like since the towel cloth 2 can be put in a desired size and shape using the mount 3. The mount 3 is of a rectangular shape, and it is made of a thick paper though not limited to this. Both longer side portions of the rectangular cake holder 11 are bent at right angles, so that the rolled towel cake 1 is placed between the bent edge portions.

The decoration includes a cherry shape decoration 5*a* with a magnet (not illustrated) attached to its rear surface and a ribbon 5*b* tied around the rolled cake body 1. The ribbon 5*b* provides a decorative effect and prevents loosening of the rolled state of the rolled cake body 1. Instead of the ribbon 5*b*, as long as it can keep the rolled cake shape unchanged, other items such as a rubber band or the like can be used.

The decorative accessory, the cake body 1, is obtained by the steps as described below with reference to FIG. 4.

First, in step (a), a towel cloth 2 is spread and set flat. When the towel cloth 2 is large, it can be folded once in half. Then, so as to be held within the towel cloth 2, the rectangular mount 3 is set in the center of the towel cloth 2 in step (b), and the towel cloth 2 is folded inward along the left and right edges of the mount 3 (or the towel cloth 2 is folded along the left and right edges of the mount 3 so as to wrap up the mount 3). Then, in step (c), the towel cloth 2 containing the mount 3 is rolled from either the top or bottom end of the folded towel cloth 2 toward another end so as to form a spiral shape, thus being completed as a rolled cake-shaped cake body. The thus obtained rolled towel cake body 1 is placed on the cake holder 11 in step (d) so as to be completed as a decorative accessory made of a towel.

Though the cake-shaping process can be finished at this point, the cake body 1 together with the cake holder 11 can be tied together with the ribbon 5*b* (see FIG. 3B), the cherry-shaped decoration 5*a* can be added, and then the cake body 1 thus decorated can wrapped with a polypropylene transparent film 8. The opening of the transparent film package is closed with a plastic material such as a decorative wire, and a ribbon 9 and a tag 10 are attached to the package.

As seen from the above, since the mount 3 is made of a thick paper with sufficient stiffness, the rolled spiral shape of the cake body 1 can be kept unchanged. It is thus possible to provide towel cake bodies of constant size and shape. Also, it is possible to provide a towel decorative accessory that appears as deliciously attractive as a real rolled cake.

The invention claimed is:

1. A method of manufacturing a cake-shaped decorative accessory made of a towel cloth comprising the steps of:

setting a mount on one surface of a towel cloth which is larger in size than said mount, said mount being in a polygonal shape and having a folding piece extending from each one of the sides of a top face portion of said polygonal shape mount, said mount becoming a framework for forming said towel cloth in a three-dimensional cake shape;

folding said towel cloth to an inside along edges of said mount and bending said folding pieces covered by said towel cloth along borders with said top face portion of said mount so as to rise at substantially right angles with respect to said top face portion to form said three-dimensional cake shape so that said top face portion faces upward, and setting said towel cloth folded into said three-dimensional cake shape into a three-dimensional cake cup having a same shape as said three-dimensional cake shape formed by said cloth towel and said mount and having a size so that said three-dimensional cake shape formed by said towel cloth and mount fits snugly when placed therein with an upper portion of said towel cloth folded into said three-dimensional cake shape protruding upward.

2. The method according to claim 1, wherein said polygonal shaped mount is triangular.

3. The method according to claim 2, further comprising packaging said cake-shaped decorative accessory in a transparent film bag.

4. The method according to claim 3, further comprising placing a decoration on top of said cake-shaped decorative accessory.

* * * * *